US007219719B2

(12) United States Patent
Gerard

(10) Patent No.: US 7,219,719 B2
(45) Date of Patent: May 22, 2007

(54) FIN FOR A PLATE HEAT EXCHANGER, METHODS FOR THE MANUFACTURE OF SUCH A FIN, AND A HEAT EXCHANGER COMPRISING SUCH A FIN

(75) Inventor: Claude Gerard, Chantraine (FR)

(73) Assignee: Nordon Cryogenie SNC, Golbey (FR)

( * ) Notice: Subject to any disclaimer, the term of this patent is extended or adjusted under 35 U.S.C. 154(b) by 264 days.

(21) Appl. No.: 10/674,340

(22) Filed: Oct. 1, 2003

(65) Prior Publication Data

US 2004/0188072 A1 Sep. 30, 2004

(30) Foreign Application Priority Data

Oct. 1, 2002 (FR) ..... 02 12140

(51) Int. Cl.
*F28F 3/02* (2006.01)

(52) U.S. Cl. ..... 165/166

(58) Field of Classification Search ..... 165/152, 165/166

See application file for complete search history.

(56) References Cited

U.S. PATENT DOCUMENTS 3,528,496 A * 9/1970 Kun ..... 165/166
5,375,655 A * 12/1994 Lee ..... 165/185
5,455,382 A 10/1995 Kojima et al.
5,653,285 A * 8/1997 Lee ..... 165/185
6,009,937 A 1/2000 Masatz et al.
6,321,451 B1 * 11/2001 Lee et al. ..... 29/890.03
6,615,909 B2 * 9/2003 Fast ..... 165/80.3
2002/0029876 A1 * 3/2002 Fast ..... 165/185
2004/0182542 A1 * 9/2004 Take et al. ..... 165/80.3

FOREIGN PATENT DOCUMENTS

EP 0 203 458 12/1986
JP 06260571 A * 9/1994
JP 08222666 A * 8/1996
JP 0 919 780 6/1999

OTHER PUBLICATIONS

Patent Abstracts of Japan vol. 1997, No. 03, Mar. 31, 1997 -& JP 08 285486 A (Kobe Steel Ltd), Nov. 1, 1996 *ambrege; figures*.

* cited by examiner

*Primary Examiner*—Allen J. Flanigan
(74) *Attorney, Agent, or Firm*—Young & Thompson

(57) ABSTRACT

A fin produced from thick sheet-metal and having a pattern reproduced in a general direction in accordance with a geometric pitch such that the ratio of the minimum thickness of the sheet-metal to the geometric pitch is greater than 0.2. The fin is obtained either by a hot-extrusion operation or by a material-removing machining operation.

16 Claims, 1 Drawing Sheet

FIN FOR A PLATE HEAT EXCHANGER, METHODS FOR THE MANUFACTURE OF SUCH A FIN, AND A HEAT EXCHANGER COMPRISING SUCH A FIN

BACKGROUND OF THE INVENTION

The present invention relates to a fin for a heat exchanger having brazed plates.

DESCRIPTION OF THE RELATED ART

Conventionally, such a heat exchanger is constituted by a stack of parallel rectangular separating plates or metal sheets which are all identical and which define therebetween a plurality of passages for fluids that are to be brought into indirect thermal exchange relation.

Arranged in each passage are spacer corrugations or corrugated fins which are used simultaneously as thermal fins, spacers between the plates, especially during brazing and to avoid any deformation of the plates when pressurised fluids are used, and as a guide for the flow of the fluids.

Those heat exchangers are generally produced from aluminium or aluminium alloy and are assembled in a single furnace brazing operation.

Generally, the spacer corrugations are obtained from thin metal sheets which typically have a thickness of from 0.15 to 0.60 mm and which are bent in a press or by means of other suitable bending tools.

The bending methods used permit the high-speed mass-production of fins having large dimensions but enable only thin metal sheets to be treated. Therefore, the mechanical resistance of a corrugation so produced, which depends greatly on the ratio of the thickness of the metal to the pitch of the corrugation, is severely limited. The thermal, hydraulic and mechanical performances of the heat exchangers are therefore limited directly by the method of forming the spacer corrugations.

Conventionally, a heat exchanger having brazed plates, which is produced from an alloy of aluminium 3003 in accordance with conventional methods of bending strips of a thickness of 0.35 mm, operates with limits of use of the order of from 80 to 100 bar.

The invention proposes to produce fins for a plate heat exchanger

SUMMARY OF THE INVENTION the mechanical resistance of which is substantially increased, in order to push back substantially the limits of use of the exchanger under fluid pressure.

To that end, a fin according to the invention is produced from thick sheet-metal, either by a hot-extrusion operation or by a material-removing machining operation, and has a pattern reproduced in a general direction in accordance with a geometric pitch such that the ratio of the minimum thickness of the sheet-metal to the geometric pitch is greater than 0.2 and preferably less than 0.8.

Thick sheet-metal is defined by a thickness greater than approximately 1 mm, especially from 1 to 2 mm.

A fin so produced also has excellent characteristics of flatness and/or regularity, which make it particularly suitable for use in a stack of brazed plates.

According to a first embodiment of the invention, the fin defines a principal general direction of corrugation and comprises corrugations which follow one another in a direction substantially perpendicular to the principal general direction, the corrugation comprising corrugation flanks connecting corrugation peaks and corrugation troughs, the corrugation peaks and the corrugation troughs defining regions for connection by brazing to respective separating plates of the exchanger.

The thickness of the sheet-metal forming the fin may be uniform or, in a variant, at least some of the connection regions have a cross-section the width of which in the transverse direction is greater than the width defined by the mutually spaced faces of the two corresponding corrugation flanks. A fin according to that variant leads to a brazed assembly of improved mechanical strength.

The fin may have beads in the regions where the corrugation peaks or corrugation troughs join the corrugation flanks.

The beads advantageously have an outside radius of substantially from 0.2 to 0.5 mm.

According to a second embodiment of the invention, the pattern has a cross-section which is substantially H-shaped.

Preferably, the peaks and troughs defined by the free ends of the H-shaped cross-section of a pattern define regions for connection by brazing to respective separating plates of the exchanger, and those regions have a thickness greater than the thickness of the other regions of the branches arranged in the shape of an H.

The mechanical strength of the fastenings of the fin to the plates is thus increased, as mentioned in the variant of the first embodiment.

The invention relates also to methods for the manufacture of such a fin.

A first method to which the invention relates comprises a hot-extrusion operation giving the fin its general shape, optionally followed by a machining operation.

A second method to which the invention relates comprises an operation of machining a metal sheet by the removal of material, giving the fin its general shape.

Finally, the invention relates to a plate heat exchanger comprising, in at least a first passage, a fin such as described above connected by brazing to two successive plates.

According to other features of the plate heat exchanger according to the invention:

- the exchanger also comprises, in at least a second passage, a fin produced from thin sheet-metal and connected by brazing to two successive plates;
- the exchanger operates with at least one fluid under a pressure greater than 100 bar, especially greater than 200 bar, and preferably of the order of 250 bar, which circulates in the first passage.

BRIEF DESCRIPTION OF THE DRAWING

Embodiments of the invention will now be described with reference to the appended drawings in which:

FIG. 1 shows part of a corrugated fin 1 of conventional crenellated general shape. The fin 1 defines a principal general direction of corrugation D1, the corrugations following one another in a direction D2 perpendicular to the direction D1.

Figure 1:
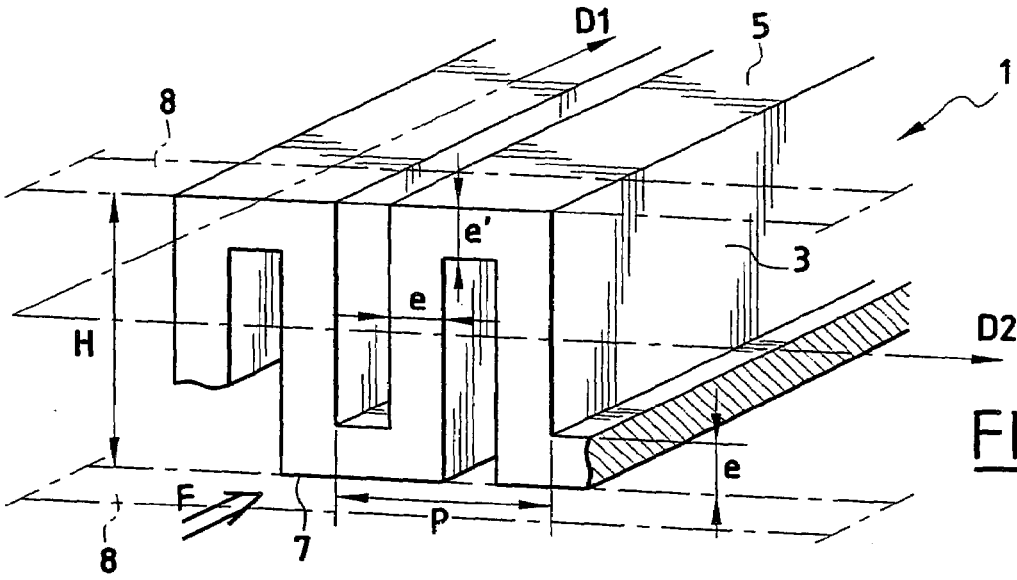
FIG. 1 is a perspective view of a portion of a corrugated fin according to a first embodiment of the invention.

For convenience of description, it will be assumed that, as shown in FIG. 1, the directions D1 and D2 are horizontal.

The direction D1 corresponds to the principal direction of circulation of a fluid F, in a heat exchanger in use.

The corrugated fin 1 comprises a large number of rectangular corrugation flanks 3 each contained in a vertical plane perpendicular to the direction D2. The corrugation flanks 3 are connected alternately along their upper edge by rectangular, flat, horizontal corrugation peaks 5, and along their lower edge by likewise rectangular, flat, horizontal corrugation troughs 7.

The corrugation peaks 5 and the corrugation troughs 7 define regions for connection by brazing to flat separating plates or metal sheets 8, shown with a dot-dash line, of the heat exchanger.

The fin 1 may be obtained from a thick metal sheet having a thickness substantially equal to the height H of the fin, which is defined by the distance separating the outer faces of a corrugation peak 5 and a corrugation trough 7 in the direction at right-angles to D1 and D2. In order to obtain the final shape of the fin, the thick metal sheet is machined, for example by milling.

Alternatively, it is possible to obtain the fin 1 by a hot-extrusion operation from a metal material in billet form.

A fin 1 so defined is characterised especially by a geometric period or pitch P representing the length, in the direction D2, of a pattern formed by a corrugation peak 5, a corrugation trough 7 and two corrugation flanks 3.

The fin 1 is also characterised by the thickness e, e' of the metal, which may be uniform over the entire fin 1 but which may differ according to the regions of the fin.

In particular, owing to the method of extruding or machining thick sheet-metal that is used for the manufacture of the fin according to the invention, it is possible to choose a first thickness e corresponding to the thickness of the metal at the corrugation flanks 3, and a second, different, thickness e' corresponding to the portions of the fin that are to be brazed onto the separating plates of the exchanger, that is to say, at the corrugation peaks 5 and the corrugation troughs 7.

The method for the manufacture of the fin according to the invention also makes it possible, compared with the techniques conventionally used for bending thin sheet-metal, to increase the ratio of the minimum thickness e or e' to the geometric pitch P and to set that ratio at from 0.2 to 0.8. Thus, it is possible to manufacture heat exchangers that operate under pressures of the order of 250 bar for alloys of aluminium 3003, while the pressures normally reached for those same alloys are of the order of from 80 to 100 bar, with fins produced from bent thin sheet-metal.

Figure 2:
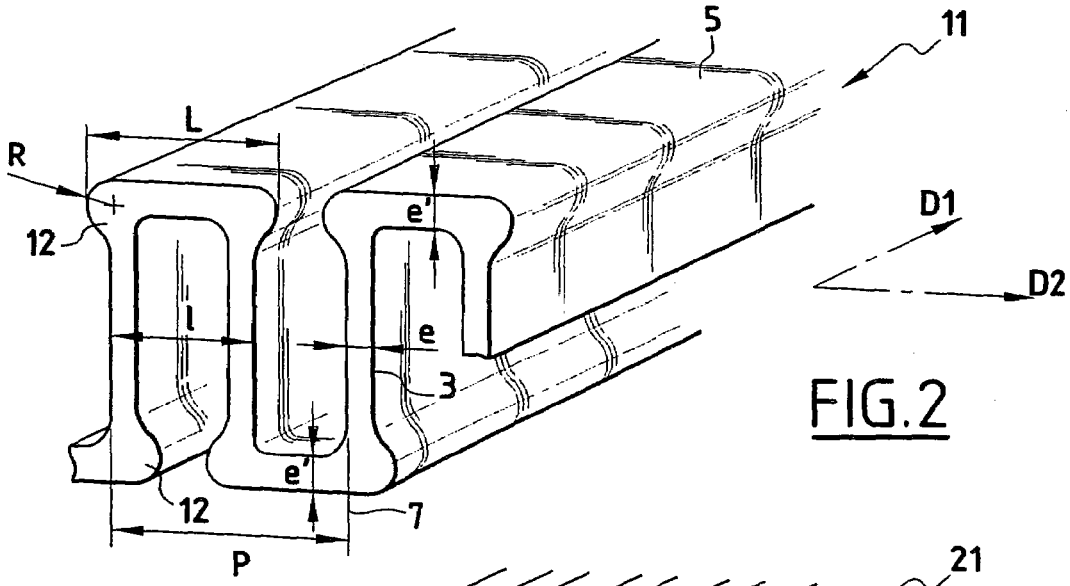
FIG. 2 is an analogous view of a variant of the first embodiment of the invention.

FIG. 2 illustrates a variant of the embodiment described above. According to this variant, the fin 11 has beads 12 in the junction regions between the corrugation peaks 5 or the corrugation troughs 7, on the one hand, and the corrugation flanks 3, on the other hand. Thus, the connection regions formed by the corrugation peaks 5 and the corrugation troughs 7 have, in a cross-sectional plane, a width L greater than the width l defined by the two corresponding corrugation flanks 3. The width L corresponds substantially to a width of contact with the separating plate of the exchanger. The width l corresponds to the width of a passage channel defined by two consecutive corrugation flanks, plus the thicknesses e of the two corrugation flanks.

The radii of the beads 12 may be selected in such a manner as to ensure a good quality of the brazing of those regions and consequently optimum mechanical strength.

In particular, outside radii R of the beads 12 of approximately from 0.2 to 0.5 mm are entirely satisfactory.

In this embodiment, the thickness e' of the corrugation peaks and the corrugation troughs 7 is greater than that e of the corrugation flanks 3.

Figure 3:
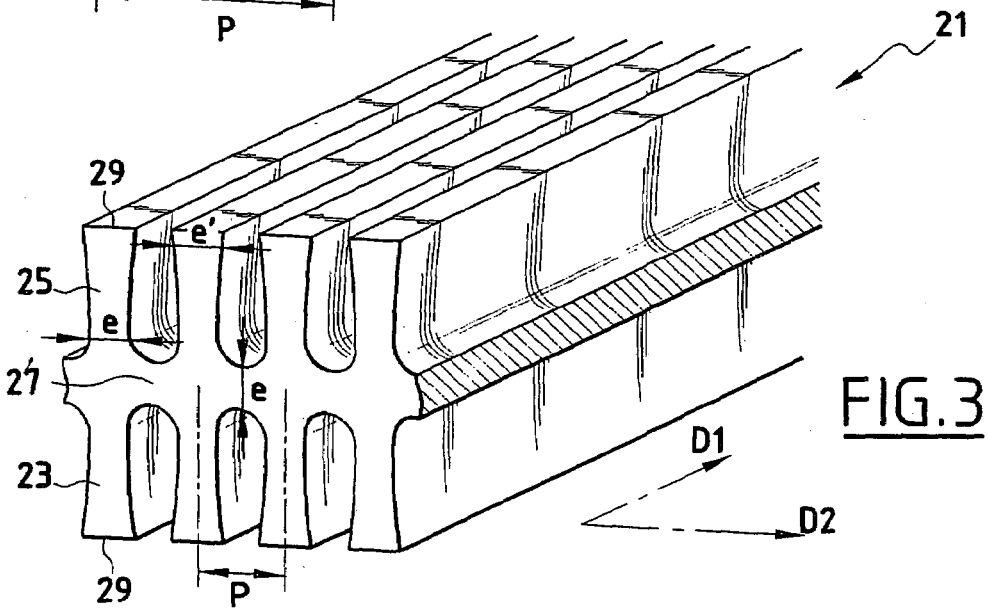
FIG. 3 is an analogous view according to a second embodiment of the invention.

Referring now to FIG. 3, a description will be given of a fin 21 defined on the basis of a pattern having a substantially H-shaped general form in cross-section, the pattern being reproduced a large number of times in the transverse general direction D2, with a geometric pitch P corresponding to the length of the pattern.

The fin 21 is defined by a plurality of vertical branches 23, 25 extending vertically downwards and upwards, respectively. The vertical branches 23, 25 have a common vertical centre plane in the embodiment shown but that plane could also be offset in the direction D2. The geometric pitch P corresponds to the spacing between the centre planes of two consecutive vertical branches 23, 25.

The branches 23, 25 are connected in an intermediate region of the height of the fin 21 by a web 27 having a horizontal general direction. Thus, the vertical branches 23, 25 define free ends 29 corresponding to the portions for connection by brazing to the respective separating metal sheets of the heat exchanger.

It will be appreciated that the horizontal webs 27, shown in a centre plane relative to the overall height of the vertical branches 23, 25, could be positioned in any other manner. In particular, they could be provided in a manner brought out of centre towards the top or towards the bottom, relative to the centre plane, and/or they could be offset vertically from one branch 23, 25 to the next.

As in the variant shown in FIG. 2, the embodiment of FIG. 3 has metal thicknesses e, e' that differ according to the regions of the fin. In this case, the free end regions 29 have a metal thickness e' greater than the thickness e of the other regions of the fin, in order to promote the mechanical strength of the assembly constituted by the fin and the separating plates.

The above description has defined fins for a heat exchanger having brazed plates, and methods for the manufacture of those fins, permitting a substantial improvement in the performance of heat exchangers using those fins.

In particular, plate heat exchangers so produced can operate at fluid pressures that are markedly higher than 100 bar, especially higher than 200 bar, up to pressures of the order of 250 bar.

In a particularly advantageous manner, it is also possible to produce heat exchangers in which one portion of the fins is according to the invention and the other portion is produced from thin sheet-metal, for example by conventional bending methods. Therefore, these exchangers can operate with fluids having markedly different pressures, the fins produced from thick sheet-metal corresponding to fluid(s) under high pressure, and the fins produced from thin sheet-metal corresponding to fluid(s) under lower pressure.

The invention claimed is:

1. A fin for a heat exchanger having brazed plates, which fin is produced from thick sheet-metal having a thickness greater than approximately 1 mm and has a pattern reproduced in a general direction (D2) in accordance with a geometric pitch (P) such that the ratio of the minimum thickness (e) of the sheet-metal to the geometric pitch (P) is greater than 0.2, characterised in that it is obtained either by a hot-extrusion operation or by a material-removing machining operation, and characterized in that the ratio is lower than 0.8.

2. A fin according to claim 1, characterised in that it defines a principal general direction of corrugation (D1) and comprises corrugations which follow one another in a direction (D2) substantially perpendicular to the principal general direction (D1), the corrugation comprising corrugation flanks (3) connecting corrugation peaks (5) and corrugation troughs (7), the corrugation peaks (5) and the corrugation troughs (7) defining regions for connection by brazing to respective separating plates (8) of the exchanger.

3. A fin according to claim 2, characterised in that at least some of the connection regions (5, 7) have a cross-section the width (L) of which in the transverse direction (D2) is greater than the width (1) defined by the mutually spaced faces of the two corresponding corrugation flanks (3).

4. A fin according to claim 2, characterised in that it has beads (12) in the regions where the corrugation peaks (5) or the corrugation troughs (7) join the corrugation flanks (3).

5. A fin according to claim 4, characterised in that the beads (12) have an outside radius CR) of substantially from 0.2 to 0.5 mm.

6. A fin according to claim 1, characterised in that the pattern has a cross-section which has substantially the general shape of an H.

7. A fin according to claim 6, characterised in that the peaks and troughs (29) defined by the free ends of the H-shaped cross-section of a pattern define regions for connection by brazing to respective separating plates of the exchanger, and those regions (29) have a thickness (e') greater than the thickness (e) of the other regions of the branches (23, 25) of the H.

8. A plate heat exchanger, characterised in that it comprises, in at least a first passage, a fin (1; 11; 21) according to claim 1, which fin is connected by brazing to two successive plates (8).

9. A plate heat exchanger according to claim 8, characterised in that it also comprises, in at least a second passage, a fin produced from thin sheet-metal and connected by brazing to two successive plates (8).

10. A plate heat exchanger according to claim 8, characterised in that it operates with at least one fluid under a pressure greater than 100 bar, especially greater than 200 bar, and preferably of the order of 250 bar, which circulates in the first passage.

11. A fin for a heat exchanger having brazed plates, which fin is produced from thick sheet-metal and has a pattern reproduced in a general direction (D2) in accordance with a geometric pitch (P) such that the ratio of the minimum thickness (e) of the sheet-metal to the geometric pitch (P) is greater than 0.2, characterised in that it defines a principal general direction of corrugation (D1) and comprises corrugations which follow one another in a direction (D2) substantially perpendicular to the principal general direction (D1), the corrugation comprising corrugation flanks (3) connecting corrugation peaks (5) and corrugation troughs (7), the corrugation peaks (5) and the corrugation troughs (7) defining regions for connection by brazing to respective separating plates (8) of the exchanger, and characterised in that at least some of the connection regions (5, 7) have a cross-section the width (L) of which in the transverse direction (D2) is greater than the width (1) defined by the mutually spaced faces of the two corresponding corrugation flanks (3).

12. The fin of claim 11, wherein, obtained either by a hot-extrusion operation or by a material-removing machining operation.

13. A fin for a heat exchanger having brazed plates, which fin is produced from thick sheet-metal and has a pattern reproduced in a general direction (D2) in accordance with a geometric pitch (P) such that the ratio of the minimum thickness (e) of the sheet-metal to the geometric pitch (P) is greater than 0.2, characterised in that it defines a principal general direction of corrugation (D1) and comprises corrugations which follow one another in a direction (D2) substantially perpendicular to the principal general direction (D1), the corrugation comprising corrugation flanks (3) connecting corrugation peaks (5) and corrugation troughs (7), the corrugation peaks (5) and the corrugation troughs (7) defining regions for connection by brazing to respective separating plates (8) of the exchanger, and characterised in that it has beads (12) in the regions where the corrugation peaks (5) or the corrugation troughs (7) join the corrugation flanks (3).

14. The fin of claim 13, wherein, obtained either by a hot-extrusion operation or by a material-removing machine operation.

15. A fin for a heat exchanger having brazed plates, which fin is produced from thick sheet-metal and has a pattern reproduced in a general direction (D2) in accordance with a geometric pitch (P) such that the ratio of the minimum thickness (e) of the sheet-metal to the geometric pitch (P) is greater than 0.2, characterised in that the pattern has a cross-section which has substantially the general shape of an H, and characterised in that the peaks and troughs (29) defined by the free ends of the H-shaped cross-section of a pattern define regions for connection by brazing to respective separating plates of the exchanger, and those regions (29) have a thickness (e') greater than the thickness (e) of the other regions of the branches (23, 25) of the H.

16. The fin of claim 15, wherein, obtained either by a hot-extrusion operation or by a material-removing machining operation.

* * * * *